United States Patent [19]

Seppala

[11] Patent Number: 4,938,003

[45] Date of Patent: Jul. 3, 1990

[54] APPARATUS FOR FILLING TWO OR MORE BAGS WITH PRODUCT

[75] Inventor: John W. Seppala, Braintree, Mass.

[73] Assignee: Pneumatic Scale Corporation, Quincy, Mass.

[21] Appl. No.: 276,180

[22] Filed: Nov. 23, 1988

Related U.S. Application Data

[63] Continuation-in-part of Ser. No. 132,343, Dec. 14, 1987, abandoned, and a continuation-in-part of Ser. No. 269,568, Nov. 10, 1988.

[51] Int. Cl.[5] ..... B65B 9/08

[52] U.S. Cl. ..... 53/171; 53/247; 53/260; 53/552

[58] Field of Search ..... 53/247, 260, 255, 551, 53/552, 554, 555, 548, 171, 539

[56] References Cited

U.S. PATENT DOCUMENTS

| | | | |
|---|---|---|---|
| 2,697,541 | 12/1954 | Patterson et al. | 226/14 |
| 3,479,795 | 11/1969 | Martin et al. . | |
| 3,724,163 | 4/1973 | Roussel | 53/552 X |
| 3,766,706 | 10/1973 | Graham | 53/260 X |
| 4,027,459 | 6/1977 | Nieskens et al. | 53/552 X |
| 4,081,943 | 4/1978 | Leasure et al. | 53/552 X |
| 4,124,967 | 11/1978 | Beer et al. | 53/446 |
| 4,269,016 | 5/1981 | Kopp et al. | 53/202 X |

FOREIGN PATENT DOCUMENTS

| | | |
|---|---|---|
| 1924949 | 8/1970 | Fed. Rep. of Germany . |
| 2050991 | 1/1981 | United Kingdom . |

*Primary Examiner*—James F. Coan
*Attorney, Agent, or Firm*—Donald Brown

[57] ABSTRACT

Apparatus for depositing two or more filled and sealed bags of product in a single box, comprising a shuttle embodying two or more chambers for successively receiving the filled and sealed bags from a filling and sealing machine for deposit of the filled and sealed bags into the box.

3 Claims, 2 Drawing Sheets

APPARATUS FOR FILLING TWO OR MORE BAGS WITH PRODUCT

PRIOR APPLICATION

This application is a continuation-in-part of U.S. patent application Ser. No. 132,343, filed Dec. 14, 1987, now abandoned and U.S. Ser. No. 269,568, filed Nov. 10, 1988.

BACKGROUND OF THE INVENTION

In U.S. Pat. Nos. 3,983,682 and 4,571,926, there is shown apparatus for filling bags with product, sealing the same and depositing the filled, sealed bags in a box. A single bag is disposed in a single box. There are instances where it is desirable to deposit two or more bags filled with product into a single box. It is the purpose of this invention to provide apparatus for forming, filling and sealing bags and depositing several such bags in a single box.

SUMMARY OF THE INVENTION

The apparatus as herein illustrated, is for filling two or more bags with the product and depositing the bags into a box. The apparatus comprises a shuttle movable with respect to a vertical filling and sealing structure for receiving a succession of filled and sealed bags and means for thereafter releasing the filled and sealed bags into a box supported therebelow. The shuttle is situated below the filling and sealing apparatus and above the box within which the filled bags are to be deposited and is movable relative to the filling and sealing means to successively receive the filled and sealed bags and thereafter release the bags into the box. The shuttle embodies chambers, each of a cross section to receive a bag and of a length corresponding to substantially the length of the bag. The chambers are open at their upper and lower ends and there are shutters for constraining the bags as they are successively deposited in the chambers until a full complement of bags is present. The shutters are situated at the lower ends of the chambers and there is means for retaining the shutters in blocking position and for thereafter releasing the shutters to release the bags. The chambers may include means for shaping the bags if desired.

In this invention filled bags are presented to a shuttle mechanism which has a multiple number of chambers for said bags. The bags in the chambers are then released into a single box therebelow.

Using this invention, two or more bags can be loaded into a single box e.g. one could have two or more bags side by side in a box (carton), or front to back in a box e.g. three in a row.

In addition, multi tiers of rows and columns of filled bags can be achieved using the invention by moving the shuttle side to side or front to back to accomplish same.

The invention will now be described in greater detail with reference to the accompanying drawings, wherein.

DETAILED DESCRIPTION OF THE INVENTION

Figure 1:
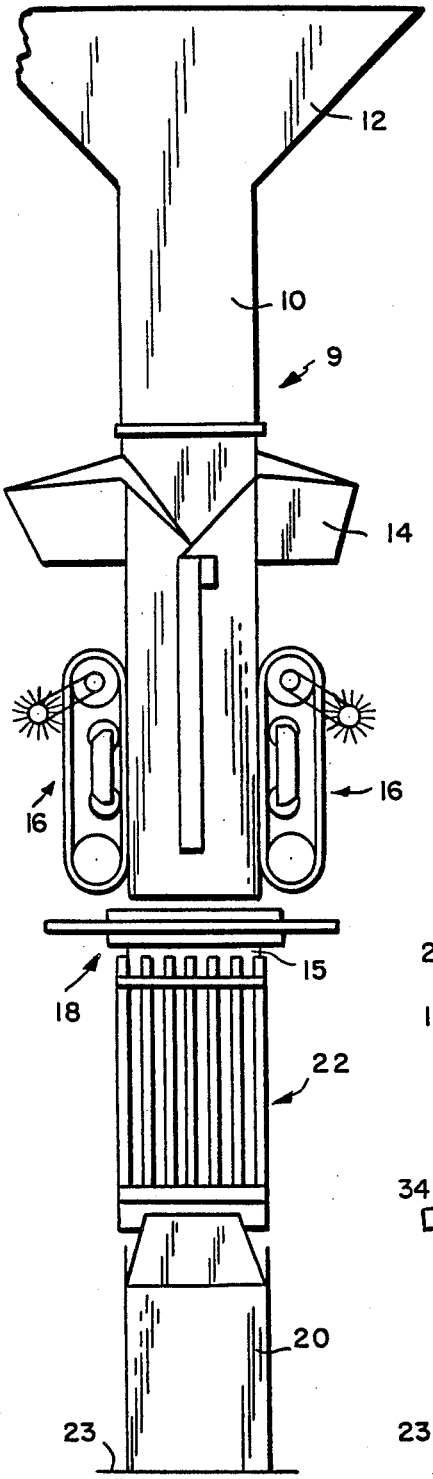
FIG. 1 is an elevation of the filling apparatus for forming bags, filling the same with product and depositing them in a box.
Figure 2:
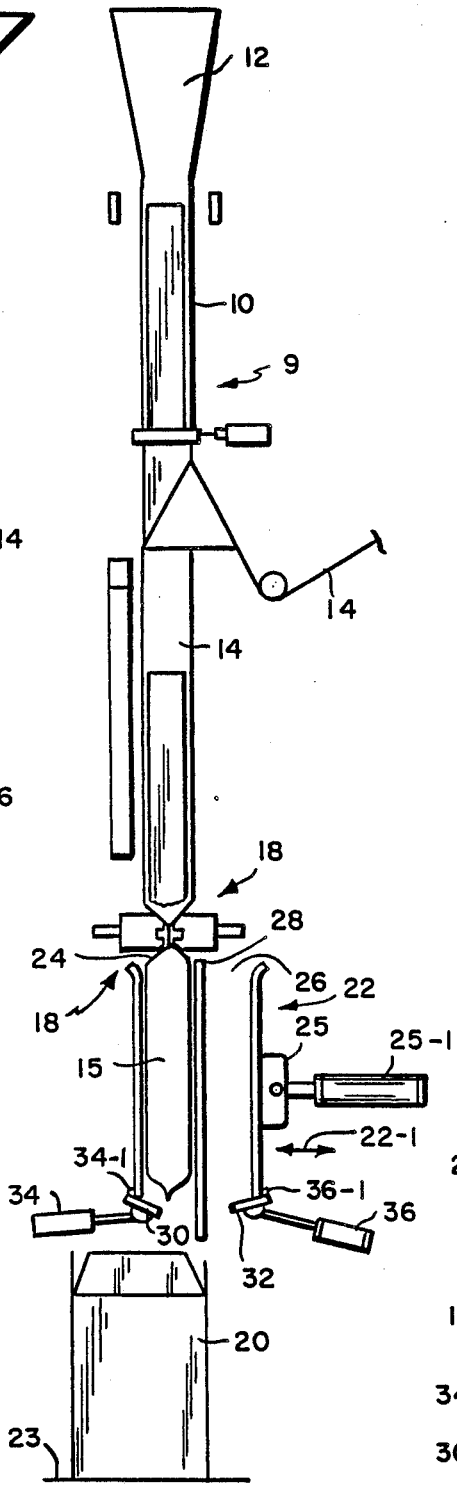
FIG. 2 is a side elevation of FIG. 1 showing the shuttle disposed between the filling and sealing apparatus and the box within which the product is to be deposited.
Figure 3:
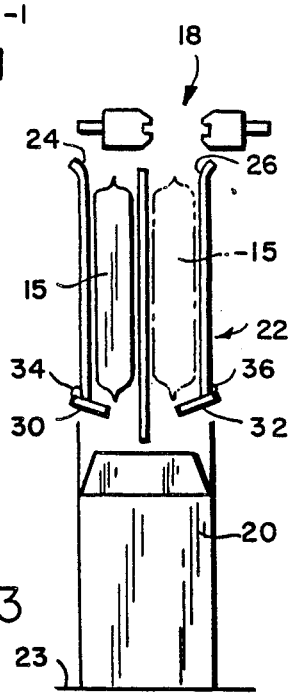
FIG. 3 is a side elevation showing the shuttle shifted to a position of alignment with the box within which the deposit is to be made.

Referring now to the drawings, FIGS. 1 and 2, the bag forming and filling apparatus 9 comprises, as shown in the aforesaid patents, a vertically-disposed mandrel in the form of a tube 10, at the upper end of which there is hopper 12 for a receiving product which is to be bagged and deposited in a carton as shown in the U.S. Pat. No. 3,983,682 and 4,571,926. Bag forming material 14 in sheet form is formed on the tube into a bag 15 and moved downwardly thereon by feeding belts 16—16. Below the lower end of the tube 10, there is sealing and severing means 18 for sealing the opposite ends of the bag after filling. A shuttle device 22 as shown herein which, as illustrated in FIGS. 2 and 3, is divided into two chambers 24 and 26 via a divider 28 disposed midway between the opposite sides. The shuttle device 22 thus provides two vertically-disposed chambers of a cross section corresponding to each of the filled bags and of a length corresponding substantially to the length of the bags. The shuttle device 22 is supported for movement transversely with respect to the filling and sealing apparatus and the box 20 into which the filled bags are to be deposited. In FIG. 2, the shuttle device 22 is shown with the chamber 24 above the carton 20 and so positioned with respect thereto that a bag 15 disposed therein will move down into the chamber 24 at the left-hand side thereof. The shuttle device 22 is thereafter moved from the position shown in FIG. 2 to a position to the left as shown in FIG. 3 to received a second bag 15 filled with product and sealed from the forming and filling apparatus 9 while shifting the previously filled and sealed bag from right to left so that now the previously sealed bag is at the left-hand side of the box and now filled bag is at the right-hand side of the box. Reciprocal movement of the shuttle device shown by arrow 22-1 is provided for by a link 25 connected to a solenoid controlled pneumatic cyclinder 25-1 to move it back and forth. Following deposit of both bags in the shuttle device 22 chambers and movement to the position shown in FIG. 3, the two bags are released e.g. simultaneously into the box 20 by moving shutters 30 and 32 as shown by the arrows in FIG. 3. The box is supported below the forming device 22 on a support 23 which may be stationary or movable to move empty cartons successively into positions as shown in the aforementioned.

Shutters 30 and 32 are provided at the lower ends of the chambers 24 and 26 to support the bags therein until the shuttle is moved to a position for depositing the bags in the carton. At 28 (See FIG. 3) there is a divider between the chambers 24 and 26 to keep the bags apart when they fall into the same box. There is appropriate means e.g. a solenoid controlled air cyclinder 34 and 36 actuatable when the shuttle 22 is moved to the depositing position to retract the shutters about hinges 34-1 and 36-1 to allow the bags 15 to drop into the box 20.

Figure 4:
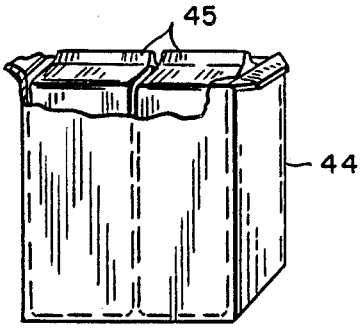
FIG. 4 shows a single box filled with the two bags positioned front to back using the apparatus of FIGS. 1 to 3.

The bags 15 after leaving the chambers are positioned as shown as in FIG. 4 in a front to back configuration.

Figure 5:
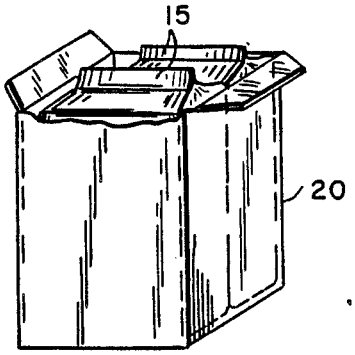
FIG. 5 shows a single box filled with two bags positioned side to side.
Figure 6:
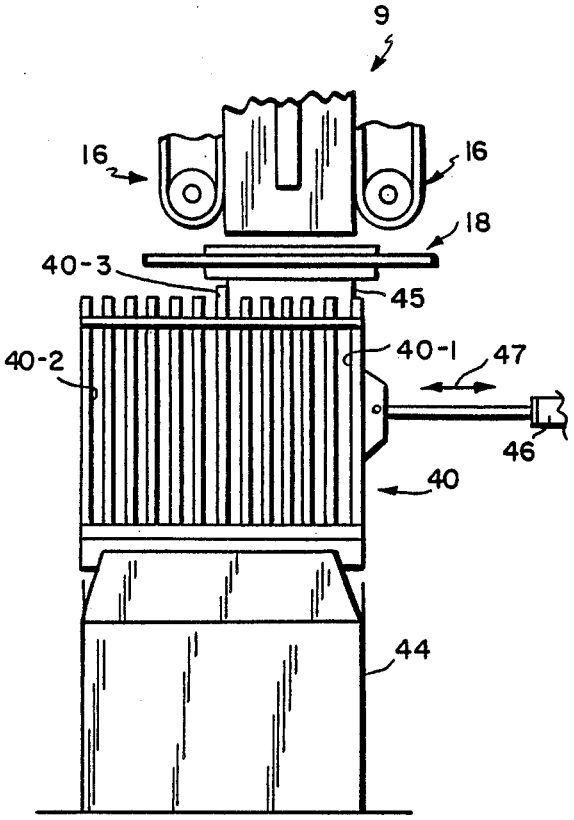
FIG. 6 shows in a front elevation a modified apparatus for positioning two bags in a side to side configuration as shown in FIG. 5.

Reference now should be had to FIGS. 5 and 6, which illustrates the apparatus in which the shuttle moves side to side rather than transversly as in FIGS. 1 to 3 to position two bags in a side to side configuration in a carton as shown in FIG. 5. In FIGS. 5 and 6, the bags are shown at 45 and the carton is shown at 44.

In FIG. 6, the shuttle is shown in 40 and includes two chambers 40-1 and 40-2, which are successively positioned to receive bags 45 from the bag filling and sealing apparatus 9. An air cyclinder is provided at 46 to move the shuttle 40 side to side as shown by the arrows 47 under the bag filling apparatus 9. The chambers 40-1 and 40-2 include as shown in FIG. 2 shutters which release the bags into the cartons. The bags are preferably dropped about the same time into the box (carton) 44. A divider is also provided at 40-3 between the chambers containing the bags as shown.

Figure 7:
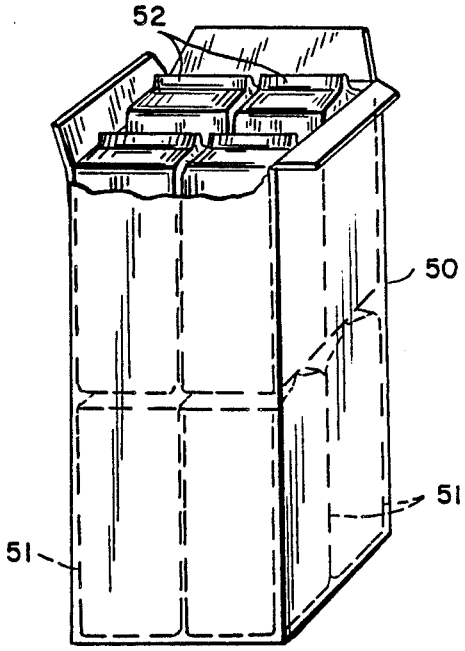
FIG. 7 illustrates a two tiered multipack of eight bags, four bags to each tier (level).

FIG. 7 represents a box 50 having two tiers of bags 51 and 52 with four bags to each tier (level). This is accomplished by using a shuttle adapted to move front to back as well transversly (side to side) and using four chambers. First one tier of four bags 51 is placed in the box 50 and then a second tier of bags 52 is placed over the first tier of bags.

While the apparatus as shown in the drawings herein submitted discloses structure wherein two bags are filled and deposited in a common carton, it is within the scope of the invention to increase the number of bags by increasing the number of chambers in the shuttle 22. It is also understood that the shuttle 22 can be further positioned to control the air cyclinder to make fine adjustments for alignment over the box. In addition, if the shuttle includes a moveable bag separator e.g. movable by a rack and pinion or long stroke cylinder, which extends into the box prior to when the bags are released or the box itself includes preformed separators or if the box is large enough the bags can just as easily be released in the box one after the other. It is also understood that in place of solenoid controlled activators, other devices e.g. mechanically activated mechanisms may be used.

It should be understood that the present disclosure is for the purpose of illustration only and includes all modifications or improvements which fall within the scope of the appended claims.

What is claimed is:

1. Apparatus for depositing two or more filled and sealed bags containing product into a single box, comprising means for supporting a box, first means above the support for forming the filling bags with product and sealing the same and means intermediate the support, and second means comprising a shuttle movable side by side or front to back with respect to said first means to successively receive filled and sealed bags and position same when filled with bags above the same box and then releasing the filled bags therefrom for deposit of the bags into the box, said shuttle embodies a plurality of chambers, each of a cross section to receive a bag and of length corresponding to substantially the length of the bag, said chambers being open at their upper and lower ends, said shuttle being movable relative to the bag forming apparatus and to the box to successively receive filled bags from the filling and sealing apparatus and to discharge all of the filled and sealed bags into the box and means for holding the bags and then releasing a complement of filled and sealed bags into the box, and means for controlling said last mentioned means to release the bags into the box, wherein there is a divider between chambers extending downwardly to a level below the upper edge of the larger closure flaps and short of the shorter closure flaps.

2. Apparatus according to claim 1 wherein said divider extends downwardly to the upper level of the lower ends of the shutters.

3. Apparatus for depositing two or more filled and sealed bags containing product into a single box, comprising means for supporting a box, first means above the support for forming and filling bags with product and sealing the same and means intermediate the support, and second means comprising a shuttle movable side by side or front to back with respect to said first means to successively receive filled and sealed bags and position same when filled with bags above the box and then releasing the filled bags therefrom for deposit of the bags into the box, said shuttle embodies a plurality of chambers, each of a cross section to receive a bag and of length corresponding to substantially the length of the bag, said chambers being open at their upper and lower ends, said shuttle being movable relative to the bag forming apparatus and to the box to successively receive filled bags from the filling and sealing apparatus and to discharge all of the filled and sealed bags into the box and means for holding the bags and then releasing a complement of filled and sealed bags into the box, and means for controlling said last mentioned means to release the bags into the box, and in which said shuttle includes a divider for maintaining the bags apart when they are released into the box from adjacent chambers.

* * * * *